US009429863B2

(12) United States Patent
Ikedo et al.

(10) Patent No.: US 9,429,863 B2
(45) Date of Patent: Aug. 30, 2016

(54) LIQUID DEVELOPING AGENT

(71) Applicant: SAKATA INX CORPORATION, Osaka (JP)

(72) Inventors: Keisuke Ikedo, Osaka (JP); Katsutoshi Okamoto, Osaka (JP); Hideo Shibata, Osaka (JP)

(73) Assignee: SAKATA INX CORPORATION, Osaka (JP)

( * ) Notice: Subject to any disclaimer, the term of this patent is extended or adjusted under 35 U.S.C. 154(b) by 0 days.

(21) Appl. No.: 14/765,801

(22) PCT Filed: Feb. 4, 2014

(86) PCT No.: PCT/JP2014/052572
§ 371 (c)(1),
(2) Date: Aug. 4, 2015

(87) PCT Pub. No.: WO2014/123121
PCT Pub. Date: Aug. 14, 2014

(65) Prior Publication Data

US 2015/0370190 A1 Dec. 24, 2015

(30) Foreign Application Priority Data

Feb. 8, 2013 (JP) ..... 2013-023140

(51) Int. Cl.
*G03G 9/13* (2006.01)
*G03G 9/12* (2006.01)
*G03G 9/125* (2006.01)

(52) U.S. Cl.
CPC ..... *G03G 9/132* (2013.01); *G03G 9/122* (2013.01); *G03G 9/125* (2013.01)

(58) Field of Classification Search
CPC ..... G03G 9/13
See application file for complete search history.

(56) References Cited

U.S. PATENT DOCUMENTS

2011/0183254 A1* 7/2011 Shoshi ..... G03G 15/10 430/112
2012/0283378 A1* 11/2012 Shoshi ..... C07F 7/0852 524/556

FOREIGN PATENT DOCUMENTS

| | | | |
|---|---|---|---|
| JP | S60-098446 | A | 6/1985 |
| JP | H10/510063 | A | 9/1998 |
| JP | 2009-096933 | A | 5/2009 |
| JP | 2009-122186 | A | 6/2009 |
| JP | 2010-181844 | A | 8/2010 |
| JP | 2011-197241 | A | 10/2011 |
| WO | WO 96/17277 | A1 | 6/1996 |
| WO | WO 2009/041634 | A | 4/2009 |

OTHER PUBLICATIONS

International Search Report mailed by Japan Patent Office on Apr. 1, 2014 in the corresponding PCT Application No. PCT/JP2014/052572—14 pages.

* cited by examiner

*Primary Examiner* — Hoa V Le
(74) *Attorney, Agent, or Firm* — Knobbe, Martens Olson & Bear LLP

(57) ABSTRACT

The object of the present invention is to provide a liquid developing agent for electrophotography or electrostatic recording obtained by utilizing the coacervation method, wherein such liquid developing agent has good abrasion resistance. To this end, a liquid developing agent is provided which is obtained by utilizing the coacervation method, comprising insulating liquid in which colored resin particles formed by at least pigment, pigment dispersant, acid-group-containing resin, binder resin, and resin whose glass transition temperature is −120 to −60° C. are dispersed, wherein the resin whose glass transition temperature is −120 to −60° C. is contained in the colored resin particle by 1.0 to 5.0 percent by mass.

8 Claims, No Drawings

LIQUID DEVELOPING AGENT

This application is the U.S. National Phase under 35 U.S.C. §371 of International Application PCT/JP2014/052572, filed Feb. 4, 2014, which claims priority to Japanese Patent Application No. 2013-023140, filed Feb. 8, 2013. The International Application was published under PCT Article 21(2) in a language other than English.

TECHNICAL FIELD

The present invention relates to a liquid developing agent for electrophotography or electrostatic recording used with printing presses, copiers, printers, facsimiles, etc.

BACKGROUND ART

Liquid developing agents in use are generally of the type comprising electrically insulating liquid in which colored resin particles containing pigment or colorant (hereinafter referred to as "toner particles") are dispersed. Various methods are used to manufacture such liquid developing agent, including: (1) the polymerization method (monomer components are polymerized in an electrically insulating liquid in which colorant is dispersed, in order to form colored resin particles), (2) the wet pulverization method (colorant and resin are mixed and kneaded at or above the melting point of the resin, after which the mixture is dried and pulverized and the resulting pulverized matters are wet-pulverized in an electrically insulating liquid in the presence of dispersant), and (3) the separation method (hereinafter referred to as "coacervation method") (a liquid mixture comprising colorant, resin, solvent that dissolves the resin, and electrically insulating liquid that does not dissolve the resin, is prepared and then the solvent is removed to separate the resin, after which colored resin particles are dispersed in the electrically insulating liquid).

The coacervation method, which is one method of manufacturing such liquid developing agent, is explained in connection with the present invention. Under the coacervation method, a liquid mixture comprising solvent that dissolves resin and electrically insulating liquid that does not dissolve resin is prepared, and then the solvent is removed to cause the dissolved resin in the liquid mixture to separate as colored resin particles in which colorant is encapsulated, and the colored resin particles are also dispersed in the electrically insulating liquid.

Liquid developing agents obtained from such method are considered to have good electrophoretic property because their colored resin particles are closer to a spherical shape than those in liquid developing agents obtained by the wet pulverization method, and the particles are also uniform in size.

However, images printed with a liquid developing agent obtained by the coacervation method present problems in that they have lower abrasion resistance than those printed with a liquid developing agent obtained by other methods.

Methods that have heretofore been proposed to improve the abrasion resistance of liquid developing agent include methods wherein wax is added (refer to Patent Literature 1, for example), and methods wherein toner particle composition resin having a specific melting temperature is used in combination with additive material (polyethylene wax, etc.) (refer to Patent Literature 2, for example).

In light of the above, the applicant for the present application for patent proposed a method wherein polyethylene wax, etc., as proposed above is contained in order to improve the abrasion resistance of liquid developing agent obtained by the coacervation method (refer to Patent Literature 3). Images obtained by this method present somewhat improved abrasion resistance, but the level is not sufficient, making this a lingering problem specific to the manufacture of liquid developing agent using the coacervation method.

PRIOR ART LITERATURES

Patent Literatures

Patent Literature 1: Japanese Patent Laid-open No. Sho 60-098446

Patent Literature 2: Japanese Translation of PCT International Patent Application No. Hei 10-510063

Patent Literature 3: Japanese Patent Laid-open No. 2009-122186

SUMMARY OF THE INVENTION

Problems to be Solved by the Invention

Accordingly, the object of the present invention is to provide a liquid developing agent for electrophotography or electrostatic recording obtained by utilizing the coacervation method, wherein such liquid developing agent has good abrasion resistance.

Means for Solving the Problems

The inventors of the present application for patent studied in earnest to achieve the aforementioned object and found that the aforementioned object could be achieved by causing colored resin particles obtained by utilizing the coacervation method, to contain resin whose glass transition temperature is −120 to −60° C., and completed the present invention.

In other words, the present invention relates to (1) a liquid developing agent obtained by utilizing the coacervation method, comprising insulating liquid in which colored resin particles formed by at least pigment, pigment dispersant, acid-group-containing resin, binder resin, and resin whose glass transition temperature is −120 to −60° C. are dispersed, wherein such liquid developing agent is characterized in that the resin whose glass transition temperature is −120 to −60° C. is contained by 1.0 to 5.0 percent by mass.

The present invention also relates to (2) a liquid developing agent according to (1) above, wherein the resin whose glass transition temperature is −120 to −60° C. has a polyester structure and/or polyether structure in its main chain.

The present invention also relates to (3) a liquid developing agent according to (2) above, wherein the resin having a polyester structure and/or polyether structure in its main chain is constituted by one or more types of resin selected from polyester polyol, polyether polyol, and polyester polyether polyol.

The present invention also relates to (4) a liquid developing agent according to any one of (1) to (3) above, characterized in that the dispersant is a carbodiimide compound that contains basic-nitrogen-containing groups and that the acid number of the acid-group-containing resin is 20 to 100 KOHmg/g.

The present invention also relates to (5) a liquid developing agent according to (3) above, characterized in that the polyester polyol is a product of reaction between polyol component containing 3-methyl-1,5-pentane diol and dicarboxylic acid.

The present invention also relates to (6) a liquid developing agent according to (5) above, characterized in that the number-average molecular weight of the polyester polyol is in a range of 500 to 5000.

Effects of the Invention

By using colored resin particles that contain resin whose glass transition temperature is −120 to −60° C., a liquid developing agent offering improved abrasion resistance while maintaining the dispersibility and electrophoretic property of toner particles is obtained.

MODE FOR CARRYING OUT THE INVENTION

The liquid developing agent proposed by the present invention is explained in detail below.

(Pigment)

For the pigment, any known inorganic pigment or organic pigment can be used. Preferably the inorganic pigment is acetylene black, graphite, colcothar, chrome yellow, ultramarine, or carbon black, for example. Also, preferably the organic pigment is azo pigment, lake pigment, phthalocyanine pigment, isoindoline pigment, anthraquinone pigment, or quinacridone pigment, for example. While the present invention does not limit the content of such pigment in any way, preferably from the viewpoint of image density it accounts for 2 to 20 percent by mass in the final liquid developing agent.

(Pigment Dispersant)

For the pigment dispersant that disperses the aforementioned pigment, any known pigment dispersant can be used.

Specific examples of the dispersant include, for example, anionic surface active agent, nonionic surface active agent, cationic surface active agent, amphoteric surface active agent, silicon surface active agent, fluorine surface active agent or other surface active agent or derivative thereof, polyurethane resin, (poly)amine derivative having polyester introduced into amino groups and/or imino groups of (poly) amine compound, carbodiimide compound with polyester side chain, polyether side chain or polyacrylic side chain (PCT International Patent Publication No. WO03/076527), carbodiimide compound with basic-nitrogen-containing groups and polyester side chain, polyether side chain or polyacrylic side chain (PCT International Patent Publication No. WO04/000950), carbodiimide compound with side chain having pigment absorbing parts (PCT International Patent Publication No. WO04/003085), or other polymeric pigment dispersing resin. In addition, commercially available equivalents of the pigment dispersant include, for example, BYK-160, 162, 164, 182 (manufactured by BYK-Chemie), EFKA-47 (manufactured by EFKA), Ajisper PB-821, 817 (manufactured by Ajinomoto), and Solsperse 24000 (manufactured by Zeneca). Under the present invention, any of these pigment dispersants can be used alone or two or more types can be combined as necessary. While the content of the pigment dispersant is not limited in any way, preferably it is 10 to 100 parts by mass relative to 100 parts by mass of the pigment. A content less than 10 parts by mass may result in insufficient dispersibility of colored resin particles in the colored resin particle dispersion product to be manufactured, while a content exceeding 100 parts by mass may cause the printability to be affected. A more preferable lower limit of the content of the pigment dispersant is 20 parts by mass, while a more preferable upper limit of the content of the pigment dispersant is 60 parts by mass.

(Binder Resin)

For the binder resin, any known binder resin that has fixing property against paper, plastic film or other adherend can be used, such as polyester resin, epoxy resin, ester resin, acrylic resin, alkyd resin, or rosin denatured resin, which can be used alone or two or more of them can be combined as necessary. Of these, polyester resin is preferable from the viewpoints of coating film resistance and printability. The content of binder resin is not limited in any way, but preferably it is 100 to 1000 parts by mass relative to 100 parts by mass of the pigment.

Note that, under the present invention, any resin containing acid groups to an acid number of less than 20 KOHmg/g can also be used as the binder resin.

(Acid-Group-Containing Resin)

The acid-group-containing resin is preferably thermoplastic resin whose acid number is 20 to 100 KOHmg/g and which has fixing property against printing paper or other adherend. Specific examples include ethylene-(meth)acrylate copolymer, ethylene-vinyl acetate copolymer, partial saponified form of ethylene-vinyl acetate copolymer, ethylene-ester (meth)acrylate copolymer, polyethylene resin, polypropylene resin and other olefin resins, thermoplastic saturated polyester resin, styrene-acrylic copolymer resin, styrene-acrylic denatured polyester resin and other styrene resins, alkyd resin, phenolic resin, epoxy resin, rosin denatured phenolic resin, rosin denatured maleic resin, rosin denatured fumaric resin, ester (meth)acrylate resin and other acrylic resins, vinyl chloride resin, vinyl acetate resin, vinylidene chloride resin, fluororesin, polyamide resin, polyacetal resin, and the like, wherein carboxylic groups, sulfonate groups, phosphate groups, and other acid groups are introduced through a method that uses a carboxylic acid compound as polymerization material or additive material, by means of peroxide treatment, or the like. Any one type mentioned above can be used, or two or more types can be combined. The aforementioned acid-group-containing resin is preferably carboxylic-group-containing resin.

If the acid number of the acid-group-containing resin is less than 20 KOHmg/g, the granularity of colored resin particles obtained by the coacervation method tends to drop, whereas a content exceeding 100 KOHmg/g is not preferable because the electrophoretic property of the particles tends to drop.

The content of acid-group-containing resin is not limited in any way, but preferably it is 0.05 to 25 parts by mass relative to 100 parts by mass of the binder resin.

(Resin Whose Glass Transition Temperature is −120 to −60° C.)

The resin whose glass transition temperature is −120 to −60° C. for improving abrasion resistance under the present invention is preferably a liquid resin whose glass transition temperature is −120 to −60° C., which is insoluble in the insulating liquids explained below but soluble in the organic solvents explained below, and whose number-average molecular weight is in a range of 500 to 5000.

The aforementioned resin is, for example, one having a polyester structure and/or polyether structure in its main chain, and preferably comprises one or more types selected from polyester polyol, polyether polyol, and polyester polyether polyol, of which polyester polyol is more preferable.

An example of the resin having a polyester structure is polyester polyol, and among different polyester polyols, a product of reaction between polyol component containing 3-methyl-1,5-pentane diol and polyvalent carboxylic acid is preferable. Examples of commercial products include Kurapol P-510 (number-average molecular weight 500, Tg=−76.7° C.), P-1010 (number-average molecular weight 1000, Tg=−70.6° C.), P-2010 (number-average molecular weight 2000, Tg=−66.6° C.), P-3010 (number-average molecular weight 3000, Tg=−64.9° C.), P-4010 (number-average molecular weight 4000, Tg=−64.4° C.), P-5010 (number-average molecular weight 5000, Tg=−63.8° C.), P-6010 (number-average molecular weight 6000, Tg=−64.3° C.), F-510 (number-average molecular weight 500, Tg=−65.5° C.), F-1010 (number-average molecular weight 1000, Tg=−62.5° C.), F-2010 (number-average molecular weight 2000, Tg=−62.7° C.), F-3010 (number-average molecular weight 3000, Tg=−62.7° C.), P-1050 (number-average molecular weight 1000, Tg=−67.8° C.), P-2050 (number-average molecular weight 2000, Tg=−60.9° C.), and P-3050 (number-average molecular weight 3000, Tg=−60.0° C.) (manufactured by Kuraray).

The resin having a polyether structure is a compound of polyether polyol and monovalent alcohol to which alkylene oxide has been added, where examples of polyether polyol include Sannix PP-1000, 2000, 3000 (manufactured by Sanyo Chemical Industries) and P-700, 1000, 2000, 3000 (manufactured by ADECA).

The content of the resin whose glass transition temperature is −120 to −60° C. is preferably 1.0 to 5.0 percent by mass, or more preferably 1.0 to 3.0 percent by mass, in the colored resin particles. If the glass transition temperature and content are outside the ranges of the present invention, abrasion resistance tends to drop, which is not desirable.

(Insulating Liquid)

Preferably the insulating liquid does not dissolve the aforementioned binder resin, acid-group-containing resin, pigment dispersant, and resin whose glass transition temperature is −120 to −60° C., and has electrical insulation property. Insulating liquids meeting this condition include non-volatile or low-volatile insulating hydrocarbons, where aliphatic hydrocarbons and alicyclic hydrocarbons are more preferable. Of these, a normal paraffin compound, isoparaffin compound, cycloparaffin compound, mixture of two or more types of the foregoing, or other paraffin solvent of high boiling point (boiling point=150° C. or more) is particularly preferable from the viewpoints of odor, harmlessness, and cost. To be specific, commercially available versions of these include, for example, Isopar G, Isopar H, Isopar L, Isopar M, Exxsol D130, Exxsol D140 (all manufactured by Exxon Chemical), Shellsol 71 (manufactured by Shell Chemicals), IP Solvent 1620, IP Solvent 2028, IP Solvent 2835 (all manufactured by Idemitsu Petrochemical), Moresco White P-40, Moresco White P-55, Moresco White P-100 (all are liquid paraffins manufactured by Matsumura Oil Research), and Liquid Paraffin No. 40-S, Liquid Paraffin No. 55-S (both are liquid paraffins manufactured by Chuo Kasei).

(Charge-Controlling Agent Used as Necessary)

In addition to the aforementioned materials, the liquid developing agent may further contain a charge-controlling agent as necessary.

The aforementioned charge-controlling agent is available largely in the two types of (1) and (2) explained below.

(1) Type that coats the colored resin particle surface with an ionizing or ion-adsorbing substance.

This type of charge-controlling agent is preferably flaxseed oil, soybean oil or other oil, alkyd resin, halogenated polymer, aromatic polycarboxylic acid, acid-group-containing water-soluble dye, or oxidative condensation product of aromatic polyamine, for example.

(2) Type that dissolves in insulating liquid and allows a substance capable of giving and receiving ions to/from colored resin particles to coexist.

This type of charge-controlling agent is preferably cobalt naphthenate, nickel naphthenate, iron naphthenate, zinc naphthenate, cobalt octylate, nickel octylate, zinc octylate, cobalt dodecylate, nickel dodecylate, zinc dodecylate, cobalt 2-ethyl hexanoate or other metal soap, metal salt of petroleum sulfonate, metal salt of ester sulfosuccinate or other sulfonate metal salt, lecithin or other phospholipid; metal complex of t-butyl salicylate or other salicylate metal salt, polyvinyl pyrrolidone resin, polyamide resin, sulfonate-containing resin, or derivative of hydroxy benzonate, for example.

(Particle Dispersion Stabilizer Used as Necessary)

In addition to the aforementioned materials, the liquid developing agent can further use particle dispersant as necessary.

The particle dispersant dissolves in insulating liquid and disperses the aforementioned colored resin particles in insulating liquid, where examples include a product of reaction between polyamine compound and self-condensation product of hydroxy carboxylic acid. When a liquid developing agent is manufactured using the coacervation method explained later, colored resin particles can be dispersed in insulating liquid in the presence of both this particle dispersant and the aforementioned acid-group-containing resin, to increase the dispersion stability of colored resin particles in the medium. This also improves the charging characteristics and electrophoretic property of colored resin particles.

The amine number of the particle dispersant is preferably 5 to 300 mgKOH/g. So long as the amine number is within the aforementioned range, the dispersion stability of colored resin particles is good and excellent charging characteristics can also be achieved. It should be noted that, in this Specification for the present application for patent, the term "amine number" represents an equivalent value (mg) of potassium hydroxide, converted from a measurement taken according to a potentiometric titration method (such as Comtite (Auto Titrator Com-900, Buret B-900, Titstation K-900) manufactured by Hiranuma Sangyo) using 0.1 N of aqueous hydrochloric acid solution relative to 1 g of solid contents of the particle dispersant.

The aforementioned polyamine compound is not limited in any way, and may be polyvinyl amine polymer, polyallyl amine polymer, polydiallyl amine polymer or diallyl amine-maleiate copolymer, for example, or it may also be any of the foregoing polymers containing polyaniline unit, polypyrrole unit, etc. In addition, the polyamine compound may be ethylene diamine or other aliphatic polyamine, cyclopentane diamine or other alicyclic polyamine, phenylene diamine or other aromatic polyamine, xylene diamine or other aromatic-aliphatic polyamine, hydrazine, or derivative thereof, for example. Of these, polyallyl amine polymer is preferable.

The aforementioned hydroxy carboxylic acid component of the self-condensation product of hydroxy carboxylic acid is not limited in any way, and may be glycol acid, lactic acid, oxy butyric acid, hydroxy veleric acid, hydroxy caproic acid, hydroxy caprylic acid, hydroxy capric acid, hydroxy lauric acid, hydroxy myristic acid, hydroxy palmitic acid, hydroxy stearic acid, recinoleic acid, ricinus fatty acid, or hydrogenated form thereof, for example. It is preferably hydroxy carboxylic acid with 12 to 20 carbon atoms, or more preferably 12-hydroxy carboxylic acid with 12 to 20 carbon atoms, or most preferably 12-hydroxy stearic acid.

A preferable type of particle dispersant is a product of reaction between polyamine compound and self-condensation product of hydroxy stearic acid, where specific examples include a product of reaction between polyallyl amine and self-condensation product of 12-hydroxy stearic acid, product of reaction between polyethylene polyamine and self-condensation product of 12-hydroxy stearic acid, product of reaction between dialkyl amino alkyl amine and self-condensation product of 12-hydroxy stearic acid, product of reaction between polyvinyl amine and self-condensation product of 12-hydroxy stearic acid, or other product of reaction between polyamine compound and self-condensation product of 12-hydroxy stearic acid. Commercially available versions of the particle dispersant include, for example, Ajisper PB817 (manufactured by Ajinomoto) and Solsperse 11200, 13940, 17000, 18000 (manufactured by Lubrizol Japan). Of these, a product of reaction between polyallyl amine and self-condensation product of 12-hydroxy stearic acid is preferable as it achieves good particle dispersibility in initial state and after long-term storage, and also in terms of excellent charging characteristics.

Under the present invention, one type of such particle dispersant or two or more types can be used, where the total content of particle dispersant is preferably 0.5 to 3.0 percent by mass in the liquid developing agent.

(Other Additives Used as Necessary)

In addition, the liquid developing agent can contain wax and other additives as necessary in connection with the specific application such as printing press, copier, printer, or facsimile.

Next, the method of manufacturing the liquid developing agent proposed by the present invention using the coacervation method, is explained.

Any known method can be used to manufacture the liquid developing agent proposed by the present invention using the coacervation method, such as the method described in Japanese Patent Laid-open No. 2003-241439 or Re-publication of PCT International Patent Publication (WO2007/000974, WO2007/000975).

The method of manufacturing liquid developing agent is explained in greater detail below. However, it should be noted that the manufacturing method explained below represents only one example of favorable embodiment of the present invention and the present invention is not limited to this in any way.

The organic solvent used for the liquid developing agent manufactured by the coacervation method below is one that dissolves the aforementioned binder resin, acid-group-containing resin, resin whose glass transition temperature is −120 to −60° C., pigment dispersant, and particle dispersant. For example, it can be tetrahydrofuran or other ether, methyl ethyl ketone, cyclohexanon or other ketone, ethyl acetate or other ester, toluene, benzene or other aromatic hydrocarbon. They can be used alone or two or more types may be combined.

The specific manufacturing method involves, first of all, partially mixing the pigment, pigment dispersant and organic solvent, and then using an Attritor, ball mill, sand mill, bead mill, or other media dispersion machine, or high-speed mixer, high-speed homogenizer, or other non-media dispersion machine, to obtain pigment dispersion liquid in which the pigment is dispersed. Next, the binder resin, acid-group-containing resin, resin whose glass transition temperature is −120 to −60° C., wax and other additives, and remaining organic solvent, are added to this pigment dispersion liquid. Thereafter, as necessary, the particle dispersant is further added, and while the mixture is agitated using a high-speed shear agitator, the insulating liquid is added to obtain a liquid mixture. When preparing the aforementioned pigment dispersion liquid, the pigment can be dispersed after adding the resins (binder resin, acid-group-containing resin) and resin whose glass transition temperature is −120 to −60° C.

Next, the organic solvent is distilled away from the aforementioned liquid mixture under agitation using the high-speed shear agitator, to obtain the liquid developing agent proposed by the present invention. If the solid content concentration of the obtained liquid developing agent is high, the insulating liquid may be added to the extent that the required solid content concentration is achieved. If necessary, a charge-controlling agent and other additives can also be added. The liquid developing agent proposed by the present invention can also be obtained by distilling away the organic solvent and adding the insulating liquid at the same time.

For the high-speed shear agitator, a homogenizer, homomixer, or other machine capable of applying agitating/shearing forces can be used. Of the different types available in terms of capacity, rotating speed, model, etc., any one deemed appropriate for the form of production can be used. If a homogenizer is used, the rotating speed is preferably 500 revolutions per minute (rpm) or higher.

The liquid developing agent proposed by the present invention is explained more specifically using examples below; however, the present invention is not at all limited to these examples so long as its purpose and scope are adhered to. Note that, in the text below, "part" and "percent" refer to "part by mass" and "percent by mass," respectively, unless otherwise specified.

<Pigment>

Pigment Black 7
Pigment Blue 15:4
Pigment Red 57:1
Pigment Yellow 180

<Pigment Dispersant>

Into a four-way flask equipped with a reflux cooling tube, nitrogen gas inlet tube, agitation bar and thermometer, 132.6 parts of toluene solution of polycarbodiimide compound having isocyanate groups and carbodiimide equivalent weight of 316 (solid content 50%) were introduced together with 12.8 parts of N-methyl diethanol amine, and the mixture was maintained at approx. 100° C. for 3 hours to cause the isocyanate groups to react with the hydroxyl groups.

Next, 169.3 parts of self-condensation product of 12-hydroxy stearic acid having carboxyl groups at its ends and number-average molecular weight of 1600 were introduced, and the mixture was maintained at approx. 80° C. for 2 hours to cause the carbodiimide groups to react with the carboxyl groups, after which toluene was distilled out under reduced pressure, to obtain pigment dispersant 1 having a number-average molecular weight of approx. 9300, basic-nitrogen-containing group of 0.4188 mmol, and carbodiimide equivalent weight of 2400 (solid content 100%).

<Particle Dispersant>

PB817 (product of reaction between polyamine compound and condensation product of hydroxy carboxylic acid, manufactured by Ajinomoto Fine-Techno)

<Binder Resin>

Vylon 220 (polyester resin, manufactured by Toyobo)

<Acid-Group-Containing Resin>

The following composition (based on mol ratio) of monomers was put through polymerization reaction to obtain acid-group-containing resin:

Stylene/Stearyl methacrylate/Acrylic acid=85/5/10 (Weight-average molecular weight 50000, acid number 50 KOHmg/g)

<Resin Whose Glass Transition Temperature is −120 to −60° C.>

Kurapol P-510 (manufactured by Kuraray)

Kurapol P-1010 (manufactured by Kuraray)

Kurapol P-2010 (manufactured by Kuraray)

Kurapol P-6010 (manufactured by Kuraray)

Sannix PP-2000 (manufactured by Sanyo Chemical Industries)

<Resin Whose Glass Transition Temperature is Outside −120 to −60° C.>

P-2012 (manufactured by Kuraray, Tg=−51° C.)

<Organic Solvent>

Methyl ethyl ketone (MEK)

<Insulating Liquid>

Moresco White P-40 (manufactured by Matsumura Oil Research)

<Charge-Controlling Agent> t-butyl salicylic acid aluminum salt

EXAMPLE 1

20.000 parts of pigment (MA285), 12.000 parts of pigment dispersant, and 68.000 parts of methyl ethyl ketone were mixed and kneaded for 15 minutes in a paint shaker using steel beads of 5 mm in diameter, followed by 2 more hours of kneading in the Eiger Motor Mill M-250 (manufactured by Eiger Japan) using zirconia beads of 0.05 mm in diameter. To 32.500 parts of this kneaded mixture, 18.860 parts of binder resin, 5.000 parts of acid-group-containing resin, 1.000 parts of polyester polyol (Kurapol P-510) and 58.000 parts of methyl ethyl ketone were added, and the mixture was heated to 50° C. and agitated. Thereafter, 1.150 parts of particle dispersant and 0.003 parts of a charge-controlling agent were added and the mixture was agitated and then diluted with 63.587 parts of IP Solvent 2028 (manufactured by Idemitsu Petrochemical) under agitation, to obtain a liquid mixture. Next, using a machine comprising a homogenizer based on closed agitation bath and a solvent distillation device connected to it (the solvent distillation device was also connected to a pressure-reducing device), the liquid mixture was heated to 50° C. with the pressure-reducing device while being agitated at high speed (rotating speed 5000 rpm) in the homogenizer, and then decompressed, to completely distill away the methyl ethyl ketone from the closed agitation bath, and the liquid developing agent of Example 1 was thus obtained.

EXAMPLE 2

The liquid developing agent of Example 2 was obtained in the same manner as in Example 1, except that the polyester polyol was changed from Kurapol P-510 to Kurapol P-1010.

EXAMPLE 3

The liquid developing agent of Example 3 was obtained in the same manner as in Example 1, except that the polyester polyol was changed from Kurapol P-510 to Kurapol P-2010.

EXAMPLE 4

The liquid developing agent of Example 4 was obtained in the same manner as in Example 1, except that the polyester polyol was changed from Kurapol P-510 to Kurapol P-5010.

EXAMPLE 5

The liquid developing agent of Example 5 was obtained in the same manner as in Example 1, except that the polyester polyol was changed from Kurapol P-510 to Kurapol F-1010.

EXAMPLE 6

20.000 parts of pigment (MA285), 12.000 parts of pigment dispersant, and 68.000 parts of methyl ethyl ketone were mixed and kneaded for 15 minutes in a paint shaker using steel beads of 5 mm in diameter, followed by 2 more hours of kneading in the Eiger Motor Mill M-250 (manufactured by Eiger Japan) using zirconia beads of 0.05 mm in diameter. To 32.500 parts of this kneaded mixture, 18.860 parts of binder resin, 5.000 parts of acid-group-containing resin, 0.400 parts of polyester polyol (Kurapol P-1010), and 58.000 parts of methyl ethyl ketone were added, and the mixture was heated to 50° C. and agitated. Thereafter, 1.150 parts of particle dispersant and 0.003 parts of a charge-controlling agent were added and the mixture was agitated and then diluted with 64.187 parts of IP Solvent 2028 (manufactured by Idemitsu Petrochemical) under agitation, to obtain a liquid mixture. Next, using a machine comprising a homogenizer based on closed agitation bath and a solvent distillation device connected to it (the solvent distillation device was also connected to a pressure-reducing device), the liquid mixture was heated to 50° C. with the pressure-reducing device while being agitated at high speed (rotating speed 5000 rpm) in the homogenizer, and then decompressed, to completely distill away the methyl ethyl ketone from the closed agitation bath, and the liquid developing agent of Example 6 was thus obtained.

EXAMPLE 7

20.000 parts of pigment (MA285), 12.000 parts of pigment dispersant, and 68.000 parts of methyl ethyl ketone were mixed and kneaded for 15 minutes in a paint shaker using steel beads of 5 mm in diameter, followed by 2 more hours of kneading in the Eiger Motor Mill M-250 (manufactured by Eiger Japan) using zirconia beads of 0.05 mm in diameter. To 32.500 parts of this kneaded mixture, 18.860 parts of binder resin, 5.000 parts of acid-group-containing resin, 1.700 parts of polyester polyol (Kurapol P-1010) and 58.000 parts of methyl ethyl ketone were added, and the mixture was heated to 50° C. and agitated. Thereafter, 1.150 parts of particle dispersant and 0.003 parts of a charge-controlling agent were added and the mixture was agitated and then diluted with 62.887 parts of IP Solvent 2028 (manufactured by Idemitsu Petrochemical) under agitation, to obtain a liquid mixture. Next, using a machine comprising a homogenizer based on closed agitation bath and a solvent distillation device connected to it (the solvent distillation device was also connected to a pressure reducing device), the liquid mixture was heated to 50° C. with the pressure reducing device while being agitated at high speed (rotating speed 5000 rpm) in the homogenizer, and then decompressed, to completely distill away the methyl ethyl ketone from the closed agitation bath, and the liquid developing agent of Example 7 was thus obtained.

EXAMPLE 8

20.000 parts of pigment (127PES), 11.080 parts of pigment dispersant, and 68.920 parts of methyl ethyl ketone were mixed and kneaded for 15 minutes in a paint shaker using steel beads of 5 mm in diameter, followed by 2 more hours of kneading in the Eiger Motor Mill M-250 (manufactured by Eiger Japan) using zirconia beads of 0.05 mm in diameter. To 32.500 parts of this kneaded mixture, 18.860 parts of binder resin, 5.000 parts of acid-group-containing resin, 1.000 parts of polyester polyol (Kurapol P-510), and 58.000 parts of methyl ethyl ketone were added, and the mixture was heated to 50° C. and agitated. Thereafter, 1.150 parts of particle dispersant and 0.003 parts of a charge-controlling agent were added and the mixture was agitated and then diluted with 63.887 parts of IP Solvent 2028 (manufactured by Idemitsu Petrochemical) under agitation, to obtain a liquid mixture. Next, using a machine comprising a homogenizer based on closed agitation bath and a solvent distillation device connected to it (the solvent distillation device was also connected to a pressure-reducing device), the liquid mixture was heated to 50° C. with the pressure-reducing device while being agitated at high speed (rotating speed 5000 rpm) in the homogenizer, and then decompressed, to completely distill away the methyl ethyl ketone from the closed agitation bath, and the liquid developing agent of Example 8 was thus obtained.

EXAMPLE 9

20.000 parts of pigment (L4B01), 13.100 parts of pigment dispersant, and 66.900 parts of methyl ethyl ketone were mixed and kneaded for 15 minutes in a paint shaker using steel beads of 5 mm in diameter, followed by 2 more hours of kneading in the Eiger Motor Mill M-250 (manufactured by Eiger Japan) using zirconia beads of 0.05 mm in diameter. To 29.000 parts of this kneaded mixture, 18.860 parts of binder resin, 5.000 parts of acid-group-containing resin, 1.000 parts of polyester polyol (Kurapol P-510), and 58.000 parts of methyl ethyl ketone were added, and the mixture was heated to 50° C. and agitated. Thereafter, 1.150 parts of particle dispersant and 0.003 parts of a charge-controlling agent were added and the mixture was agitated and then diluted with 64.387 parts of IP Solvent 2028 (manufactured by Idemitsu Petrochemical) under agitation, to obtain a liquid mixture. Next, using a machine comprising a homogenizer based on closed agitation bath and a solvent distillation device connected to it (the solvent distillation device was also connected to a pressure reducing device), the liquid mixture was heated to 50° C. with the pressure reducing device while being agitated at high speed (rotating speed 5000 rpm) in the homogenizer, and then decompressed, to completely distill away the methyl ethyl ketone from the closed agitation bath, and the liquid developing agent of Example 9 was thus obtained.

EXAMPLE 10

20.000 parts of pigment (PHG), 5.530 parts of pigment dispersant, and 74.470 parts of methyl ethyl ketone were mixed and kneaded for 15 minutes in a paint shaker using steel beads of 5 mm in diameter, followed by 2 more hours of kneading in the Eiger Motor Mill M-250 (manufactured by Eiger Japan) using zirconia beads of 0.05 mm in diameter. To 32.500 parts of this kneaded mixture, 18.860 parts of binder resin, 5.000 parts of acid-group-containing resin, 1.000 parts of polyester polyol (Kurapol P-510) and 58.000 parts of methyl ethyl ketone were added, and the mixture was heated to 50° C. and agitated. Thereafter, 1.150 parts of particle dispersant and 0.003 parts of a charge-controlling agent were added and the mixture was agitated and then diluted with 65.687 parts of IP Solvent 2028 (manufactured by Idemitsu Petrochemical) under agitation, to obtain a liquid mixture. Next, using a machine comprising a homogenizer based on closed agitation bath and a solvent distillation device connected to it (the solvent distillation device was also connected to a pressure-reducing device), the liquid mixture was heated to 50° C. with the pressure-reducing device while being agitated at high speed (rotating speed 5000 rpm) in the homogenizer, and then decompressed, to completely distill away the methyl ethyl ketone from the closed agitation bath, and the liquid developing agent of Example 10 was thus obtained.

EXAMPLE 11

The liquid developing agent of Example 11 was obtained in the same manner as in Example 1, except that the polyester polyol (Kurapol P-510) was changed to polypropylene glycol (Sannix PP-2000).

COMPARATIVE EXAMPLE 1

The liquid developing agent of Comparative Example 1 was obtained in the same manner as in Example 1, except that the polyester polyol was changed from Kurapol P-510 to Kurapol P-1012.

COMPARATIVE EXAMPLE 2

20.000 parts of pigment (MA285), 12.000 parts of pigment dispersant, and 68.000 parts of methyl ethyl ketone were mixed and kneaded for 15 minutes in a paint shaker using steel beads of 5 mm in diameter, followed by 2 more hours of kneading in the Eiger Motor Mill M-250 (manufactured by Eiger Japan) using zirconia beads of 0.05 mm in diameter. To 32.500 parts of this kneaded mixture, 18.860 parts of binder resin, 5.000 parts of acid-group-containing resin, 0.200 parts of polyester polyol (Kurapol P-510) and 58.000 parts of methyl ethyl ketone were added, and the mixture was heated to 50° C. and agitated. Thereafter, 1.150 parts of particle dispersant and 0.003 parts of a charge-controlling agent were added and the mixture was agitated and then diluted with 64.387 parts of IP Solvent 2028 (manufactured by Idemitsu Petrochemical) under agitation, to obtain a liquid mixture. Next, using a machine comprising a homogenizer based on closed agitation bath and a solvent distillation device connected to it (the solvent distillation device was also connected to a pressure-reducing device), the liquid mixture was heated to 50° C. with the pressure-reducing device while being agitated at high speed (rotating speed 5000 rpm) in the homogenizer, and then decompressed, to completely distill away the methyl ethyl ketone from the closed agitation bath, and the liquid developing agent of Comparative Example 2 was thus obtained.

COMPARATIVE EXAMPLE 3

20.000 parts of pigment (MA285), 12.000 parts of pigment dispersant, and 68.000 parts of methyl ethyl ketone were mixed and kneaded for 15 minutes in a paint shaker using steel beads of 5 mm in diameter, followed by 2 more hours of kneading in the Eiger Motor Mill M-250 (manufactured by Eiger Japan) using zirconia beads of 0.05 mm in diameter. To 32.500 parts of this kneaded mixture, 18.860 parts of binder resin, 5.000 parts of acid-group-containing resin, 2.500 parts of polyester polyol (Kurapol P-510), and 58.000 parts of methyl ethyl ketone were added, and the mixture was heated to 50° C. and agitated. Thereafter, 1.150 parts of particle dispersant and 0.003 parts of a charge-controlling agent were added and the mixture was agitated and then diluted with 62.087 parts of IP Solvent 2028 (manufactured by Idemitsu Petrochemical) under agitation, to obtain a liquid mixture. Next, using a machine comprising a homogenizer based on closed agitation bath and a solvent distillation device connected to it (the solvent distillation device was also connected to a pressure-reducing device), the liquid mixture was heated to 50° C. with the pressure-reducing device while being agitated at high speed (rotating speed 5000 rpm) in the homogenizer, and then decompressed, to completely distill away the methyl ethyl ketone from the closed agitation bath, and the liquid developing agent of Comparative Example 3 was thus obtained.

<Evaluation Methods>

The evaluation methods described below were used to evaluate the liquid developing agents of Examples 1 to 11 and Comparative Examples of 1 to 3, the results of which are shown in Table 1.

(Viscosity)

Viscosity at 25° C. was measured with a type E viscometer (5 rpm) (unit: mmPa).

(Average Particle Size of Colored Resin Particles)

Particle size (average particle size of colored resin particles (unit: μm)) was visually measured using the optical microscope BH-2 (manufactured by Olympus).

(Charging Property and Electrophoretic Property)

Particles were observed using an electrophoresis cell.

(Conditions: 80 μm distance between electrodes, 200 V voltage applied)

(1) Electrophoretic Property

○: Particles migrate without aggregating.

Δ: Particles migrate by forming aggregates.

x: Particles aggregate between the electrodes and do not move.

(2) Charging Property

When voltage is applied to the electrophoresis cell:

+: 90% or more of toner particles migrate to the negative electrode side.

−: 90% or more of toner particles migrate to the positive electrode side.

±: Other than the above (Abrasion Resistance)

Each liquid developing agent was supplied between rollers and then voltage was applied to cause the particles in the liquid developing agent to undergo electrophoresis, after which the liquid developing agent on the roll roller on the negative electrode side was transferred onto a sheet of paper, which was then dried for 30 minutes in a 120° C. oven and then subjected to abrasion test using a JSPS abrasion tester (200 g, 10 times).

○: No scratch marks were found on the printed surface.

Δ: Less than 10% of the abrasion-tested area peeled.

x: 10% or more of the abrasion-tested area peeled.

TABLE 1

| Composition | | Example 1 | 2 | 3 | 4 | 5 | 6 | 7 |
|---|---|---|---|---|---|---|---|---|
| Pigment | MA285 | 6.5 | 6.5 | 6.5 | 6.5 | 6.5 | 6.5 | 6.5 |
| | 127PES | — | — | — | — | — | — | — |
| | L4B01 | — | — | — | — | — | — | — |
| | PHG | — | — | — | — | — | — | — |
| Pigment dispersant | | 3.9 | 3.9 | 3.9 | 3.9 | 3.9 | 3.9 | 3.9 |
| Binder resin | | 18.86 | 18.86 | 18.86 | 18.86 | 18.86 | 18.86 | 18.86 |
| Acid-group-containing resin | | 5.0 | 5.0 | 5.0 | 5.0 | 5.0 | 5.0 | 5.0 |
| Polyester polyol | P-510 | 1.0 | — | — | — | — | — | — |
| | P-1010 | — | 1.0 | — | — | — | 0.4 | 1.7 |
| | P-2010 | — | — | 1.0 | — | — | — | — |
| | P-5010 | — | — | — | 1.0 | — | — | — |
| | F-1010 | — | — | — | — | 1.0 | — | — |
| | P-1012 | — | — | — | — | — | — | — |
| | PP-2000 | — | — | — | — | — | — | — |
| Particle dispersant | | 1.15 | 1.15 | 1.15 | 1.15 | 1.15 | 1.15 | 1.15 |
| Charge controlling agent | | 0.003 | 0.003 | 0.003 | 0.003 | 0.003 | 0.003 | 0.003 |
| Insulating hydrocarbon organic solvent | | 63.59 | 63.59 | 63.59 | 63.59 | 63.59 | 64.19 | 62.89 |
| Total | | 100 | 100 | 100 | 100 | 100 | 100 | 100 |
| Content ratio of polyester polyol in colored resin particle | | 2.7% | 2.7% | 2.7% | 2.7% | 2.7% | 1.1% | 4.60% |
| <Evaluation> | | | | | | | | |
| Viscosity (mmPa) | | 60 | 40 | 35 | 30 | 40 | 40 | 45 |
| Average primary particle size of colored resin particles (μm) | | 0.8 | 0.8 | 0.8 | 0.8 | 0.8 | 0.8 | 0.8 |
| Electrophoretic property | | ○ | ○ | ○ | ○ | ○ | ○ | ○ |
| Charging property | | + | + | + | + | + | + | + |
| Abrasion resistance | | ○ | ○ | ○ | ○ | ○ | ○ | ○ |

| Composition | Comparative Example 1 | 2 | 3 | Example 8 | 9 | 10 | 11 |
|---|---|---|---|---|---|---|---|

TABLE 1-continued

| | | | | | | | | |
|---|---|---|---|---|---|---|---|---|
| Pigment | MA285 | 6.5 | 6.5 | 6.5 | — | — | — | 6.5 |
| | 127PES | — | — | — | 6.5 | — | — | — |
| | L4B01 | — | — | — | — | 5.8 | — | — |
| | PHG | — | — | — | — | — | 6.5 | — |
| Pigment dispersant | | 3.9 | 3.9 | 3.9 | 2.6 | 1.16 | 1.3 | 3.9 |
| Binder resin | | 18.86 | 18.86 | 18.86 | 18.86 | 18.86 | 18.86 | 18.86 |
| Acid-group-containing resin | | 5.0 | 5.0 | 5.0 | 5.0 | 5.0 | 5.0 | 5.0 |
| Polyester polyol | P-510 | — | — | — | — | — | — | — |
| | P-1010 | — | 0.2 | 2.5 | — | — | — | — |
| | P-2010 | — | — | — | 1.0 | 1.0 | 1.0 | — |
| | P-5010 | — | — | — | — | — | — | — |
| | F-1010 | — | — | — | — | — | — | — |
| | P-1012 | 1.0 | — | — | — | — | — | — |
| | PP-2000 | — | — | — | — | — | — | 1.0 |
| Particle dispersant | | 1.15 | 1.15 | 1.15 | 1.15 | 1.15 | 1.15 | 1.15 |
| Charge controlling agent | | 0.003 | 0.003 | 0.003 | 0.003 | 0.003 | 0.003 | 0.003 |
| Insulating hydrocarbon organic solvent | | 63.59 | 64.39 | 62.09 | 63.89 | 64.39 | 65.69 | 63.59 |
| Total | | 100 | 100 | 100 | 99 | 97.36 | 99.5 | 100 |
| Content ratio of polyester polyol in colored resin particle | | 2.7% | 0.5% | 6.6% | 2.8% | 2.8% | 2.9% | 2.7% |
| <Evaluation> | | | | | | | | |
| Viscosity (mmPa) | | 40 | 40 | 55 | 50 | 70 | 30 | 30 |
| Average primary particle size of colored resin particles (μm) | | 0.8 | 0.8 | 0.8 | 0.8 | 0.8 | 0.8 | 0.8 |
| Electrophoretic property | | ○ | ○ | ○ | ○ | ○ | ○ | ○ |
| Charging property | | + | + | + | + | + | + | + |
| Abrasion resistance | | X | Δ | Δ | ○ | ○ | ○ | ○ |

Based on the results of Examples 1 to 11 and Comparative Examples 1 to 3 above, the liquid developing agents of all these examples and comparative examples had the same average primary particle size and excellent charging property.

As for Examples 1 to 11, excellent abrasion resistance was observed and the abrasion test created no scratches on the printed surface, but when the polyester polyol with Tg of −51° C. was used under the same conditions, as represented by Comparative Example 1, 10% or more of the tested area peeled, which is a clear indication of poor abrasion resistance.

In addition, the abrasion test led to peeling of less than 10% of the tested area in Comparative Examples 2 and 3, where the colored resin particles contained 0.7 percent by mass and 6.7 percent by mass of polyester polyol, respectively—levels deviating from the range specified under the present invention. That is, in Comparative Examples 1 to 3, 10% or more of the area peeled, or despite the limited area of less than 10%, the surface did peel.

The invention claimed is:

1. A liquid developing agent obtained by utilizing a coacervation method, comprising an insulating liquid in which colored resin particles formed by at least a pigment, pigment dispersant, acid-group-containing resin, binder resin, and resin whose glass transition temperature is −120 to −60° C. are dispersed, wherein the resin whose glass transition temperature is −120 to −60° C. is contained in the colored resin particle by 1.0 to 5.0 percent by mass.

2. A liquid developing agent according to claim 1, wherein the resin whose glass transition temperature is −120 to −60° C. has a polyester structure and/or polyether structure in its main chain.

3. A liquid developing agent according to claim 2, wherein the resin having a polyester structure and/or polyether structure in its main chain is constituted by one or more types of resin selected from polyester polyol, polyether polyol, and polyester polyether polyol.

4. A liquid developing agent according to claim 1 above, wherein the dispersant is a carbodiimide compound that contains basic-nitrogen-containing groups and an acid number of the acid-group-containing resin is 20 to 100 KOHmg/g.

5. A liquid developing agent according to claim 3, wherein the polyester polyol is a product of reaction between polyol component containing 3-methyl-1,5-pentane diol and dicarboxylic acid.

6. A liquid developing agent according to claim 5, wherein a number-average molecular weight of the polyester polyol is in a range of 500 to 5000.

7. A liquid developing agent according to claim 2 above, wherein the dispersant is a carbodiimide compound that contains basic-nitrogen-containing groups and an acid number of the acid-group-containing resin is 20 to 100 KOHmg/g.

8. A liquid developing agent according to claim 3 above, wherein the dispersant is a carbodiimide compound that contains basic-nitrogen-containing groups and an acid number of the acid-group-containing resin is 20 to 100 KOHmg/g.

* * * * *